US006568409B1

(12) United States Patent
Fleck

(10) Patent No.: US 6,568,409 B1
(45) Date of Patent: May 27, 2003

(54) ULTRASONIC PARTS WASHER APPARATUS

(75) Inventor: Steven W. Fleck, Dunwoody, GA (US)

(73) Assignee: MCF Systems Atlanta, Inc., Decatur, GA (US)

( * ) Notice: Subject to any disclaimer, the term of this patent is extended or adjusted under 35 U.S.C. 154(b) by 30 days.

(21) Appl. No.: 09/722,865

(22) Filed: Nov. 27, 2000

Related U.S. Application Data

(63) Continuation-in-part of application No. 09/535,475, filed on Mar. 24, 2000, now abandoned.
(60) Provisional application No. 60/126,551, filed on Mar. 26, 1999.

(51) Int. Cl.[7] ..... B08B 3/12
(52) U.S. Cl. ..... 134/110; 134/186
(58) Field of Search ..... 134/10, 18, 42, 134/56 R, 105, 108, 110, 111, 109 R, 169 A, 186

(56) References Cited

U.S. PATENT DOCUMENTS

| | | | | | |
|---|---|---|---|---|---|
| 3,522,814 | A | | 8/1970 | Olson | 134/118 |
| 3,590,863 | A | * | 7/1971 | Faust et al. | 134/144 |
| 4,056,114 | A | | 11/1977 | Boutillette | 134/104.4 |
| 4,652,368 | A | * | 3/1987 | Ennis et al. | 210/97 |
| 4,801,333 | A | | 1/1989 | Mosell | 134/7 |
| 4,917,807 | A | * | 4/1990 | Prisco, Jr. et al. | 210/774 |
| 5,056,274 | A | * | 10/1991 | Stern | 51/425 |
| 5,113,881 | A | * | 5/1992 | Lin et al. | 134/1 |
| 5,159,945 | A | * | 11/1992 | Bannon | 134/85 |
| 5,201,958 | A | | 4/1993 | Breunsbach et al. | 134/1 |
| 5,230,824 | A | | 7/1993 | Carlson, Sr. et al. | 510/245 |
| 5,232,299 | A | | 8/1993 | Hiss | 401/143 |
| 5,248,456 | A | * | 9/1993 | Evans, Jr. et al. | 264/22 |
| 5,322,078 | A | | 6/1994 | Tuttle | 134/104.4 |
| 5,322,082 | A | | 6/1994 | Shibano | 134/186 |
| 5,328,518 | A | | 7/1994 | Hamilton et al. | 134/10 |
| 5,345,958 | A | | 9/1994 | Otsuka | 134/105 |
| 5,352,296 | A | | 10/1994 | Wittel et al. | 134/2 |
| 5,378,287 | A | * | 1/1995 | Pedziwiatr | 134/1 |
| 5,456,842 | A | * | 10/1995 | Kibblehouse et al. | 210/649 |
| 5,509,970 | A | | 4/1996 | Shiramizu | 134/3 |
| 5,542,983 | A | | 8/1996 | Hamilton et al. | 134/2 |
| 5,720,308 | A | | 2/1998 | Danowski et al. | 134/111 |
| 5,902,415 | A | * | 5/1999 | Dunn et al. | 134/42 |
| 5,965,015 | A | * | 10/1999 | Ronan et al. | 210/87 |
| 6,090,213 | A | * | 7/2000 | Moyers | 134/1 |

* cited by examiner

*Primary Examiner*—Alexander Markoff
*Assistant Examiner*—Joseph Perrin
(74) *Attorney, Agent, or Firm*—Gardner Groff, P.C.

(57) ABSTRACT

An ultrasonic cleaning apparatus (10) and method for use with a cleaning solution for cleaning soiled items, such as automobile parts. The cleaning apparatus includes a cleaning tank (11) for containing a quantity of the cleaning solution therein, with the cleaning tank having a bottom and a top. An ultrasonic generator (17, 18, 122) is provided for ultrasonically exciting the cleaning solution contained within the tank. The tank includes an upper drain (32, 33 or weir 200) and a lower drain (21). A coalescing filter (14) is used for filtering the cleaning solution. A sump tank (12) provides an extra quantity of the cleaning solution for at times overfilling the tank to draw off light ends of oils and greases from the top of the tank. At other times, the lower drain is used to draw off heavy ends of greases and oils from the bottom of the tank.

35 Claims, 8 Drawing Sheets

121b - is like 121 but pressure spigot is not over tank II

ULTRASONIC PARTS WASHER APPARATUS

CROSS-REFERENCE TO RELATED APPLICATIONS

This application is a continuation-in-part of U.S. application Ser. No. 09/535,475, filed Mar. 24, 2000, now abandon which claims priority to U.S. application Ser. No. 60/126,551, filed Mar. 26, 1999, both of which are incorporated herein by reference in their entireties.

TECHNICAL FIELD

The present invention relates generally to a cleaning apparatus and in particular relates to a parts washing apparatus for cleaning metal parts, such as is commonly employed in garages, machine shops, factories, etc.

BACKGROUND OF THE INVENTION

In the past, it was common to clean oily and greasy metal parts, such as automobile parts and machined metal parts in a machine shop, using simply a bucket containing a quantity of gasoline and a stiff brush. Gasoline is very effective as a solvent in dissolving greases and oils into the gasoline. However, certain problems existed with this approach. Firstly, gasoline is highly flammable, presenting a substantial danger of fire and explosion. Secondly, prolonged skin contact with gasoline can lead to irritation and other health problems. Thirdly, gasoline vapors are harmful when inhaled. Fourthly, the solvent-in-a-bucket approach leads to fairly rapid contamination of the solvent.

Many of these shortcomings of the solvent-in-a-bucket approach were largely overcome by the introduction of the solvent-based sink washers which have proliferated in recent years. The Safety Kleen Corporation of Elgin, Ill. has placed and serviced untold numbers of parts washers generally made in accordance with U.S. Pat. No. 3,522,814. As taught in the '814 patent, solvent (nominally mineral spirits) is re-circulated through a tank and a sink, and a removable liner or bag is provided which can be easily removed and discarded to remove contaminants from the solvent (at least some of the contaminants). The sink includes a hinged cover which is held in place by a fusible link such that in the event of fire, the fusible link melts and allows the cover to close over the sink, thereby reducing the risk of further fire and/or explosion. The solvent sink described in the '814 patent and distributed and serviced by Safety Kleen Corporation has been almost universally embraced by garages, factories, repair shops of all types, machine shops, etc.

Despite this wide-spread success of the solvent-sink type parts washer, some problems remain with the use of solvents in the washing of parts. For example, while such solvents are less prone to ignition than is gasoline, they still present something of a risk of fire. Moreover, such solvents inherently have environmental problems associated with them. Such environmental problems are attendant upon the production, distribution, use, and reclamation of such solvents. Moreover, such solvents can present an occupational safety hazard, both in terms of breathing noxious vapors and irritation (and perhaps other problems) associated with direct contact with the user's skin.

While the solvent-based parts washers are still in extremely widespread use and are still very effective for cleaning parts, many people have recognized that there is a need for a non-solvent based system. Thus, numerous attempts have been made to provide an aqueous-based parts washer. In general, these have suffered from problems as well, most notably a lack of effectiveness. In addition, prior aqueous-based parts washers have tended to be large and bulky, expensive, involve the use of caustic solutions, and the solutions employed have become quickly contaminated.

For example, one type of parts washer that has been used in the past is the so-called automatic jet washer. Such a machine is, in concept, similar to a kitchen dishwasher. The parts are placed in a cabinet and the cabinet is sealed up. Then a water-based detergent solution is sprayed onto the parts in a narrow, high impact spray pattern and either the parts are rotated through the spray pattern or the spray pattern is rotated around the parts. Normally, the water-based detergent solution is heated to improve the cleaning abilities of the solution. Such automatic jet washers are normally expensive and bulky. Moreover, because of the closed cabinet, they normally do not allow hand cleaning of parts, which can be a drawback when one wants to do just a little more cleaning of a part that has already been cleaned or one wants to clean only lightly a part which has not yet been cleaned.

As described in the background portion of U.S. Pat. No. 5,650,385, it has also been known to provide a sink-type parts washer using an aqueous solution. However, as described in the '385 patent, known solutions used in such sink-type parts washers have tended to be exceedingly alkaline, having pH values of 13 and above in order to provide effective cleaning of the parts. However, solutions with such high pH's tend to be highly corrosive both to the parts and to the users of the cleaning apparatus. The '385 patent further describes that the use of a more moderate pH aqueous solutions tends to compromise the effectiveness of the solution, thereby reducing its desirability.

In addition to the effectiveness problem identified above and the pH (corrosiveness) problem identified above, another problem exists with the use of aqueous-based solutions. Once an aqueous based solution is used effectively to clean metal parts, such an aqueous-based solution typically becomes contaminated rather quickly. In the known prior art, it has been common to use highly detergent solutions which have the effect of completely emulsifying oils and greases in the solution. Once the solution becomes heavily laden with emulsified greases and oils, the effectiveness of the solution for further cleaning subsequent parts is dramatically reduced. Moreover, even where the effectiveness of the solution can be maintained, it often gives the appearance of being "dirty", thereby reducing user confidence therein.

Accordingly, it can be seen that a need yet remains for a parts washing apparatus which utilizes an aqueous based solution and which is effective, safe, and economical. Moreover, it can be seen that a need yet remains for such an apparatus in which the effectiveness of the solution and the cleanliness thereof can be maintained over many uses thereof. It is to the provision of such a parts washer apparatus that the present invention is primarily directed.

SUMMARY OF THE INVENTION

Briefly described, in a preferred form, the present invention comprises an ultrasonic cleaning apparatus for use with a cleaning solution for cleaning items, such as automobile parts. The apparatus includes a cleaning tank for containing a quantity of the cleaning solution therein in which items to be cleaned can be placed therein. The apparatus includes an ultrasonic generator for ultrasonically exciting the cleaning solution contained within the cleaning tank. At least one upper drain is provided for drawing liquid from adjacent an upper surface of the cleaning solution contained within the tank. The apparatus also includes at least one lower drain for drawing liquid from adjacent the bottom of the cleaning tank. In one embodiment, control means are provided to draw liquid at times from the upper drain and for at other times drawing liquid from the lower drain. Also, a filter is provided for filtering liquid drawn from the cleaning tank and returning filtered liquid to the cleaning tank. Also preferably, the filter comprises a coalescing filter.

Preferably, the control means is operable for alternately drawing liquid from the lower drain and from the upper drain in an alternating cycle. Preferably, the alternating cycle of drawing from the upper drain and then from the lower drain is utilized when the ultrasonic generator is not operating. Alternatively, the control means is adapted for continuously drawing liquid from the upper drain. Also preferably, a pump is provided for recirculating cleaning solution through the filter and the tank.

Further, the invention preferably includes a sump tank, which does not have to be a separate tank, for housing an additional quantity of cleaning solution which, at times, can be pumped into the cleaning tank to facilitate the removal of light ends of oils and greases from the cleaning tank by raising the level of cleaning solution in the cleaning tank.

In another aspect, the present invention relates to an ultrasonic parts cleaning apparatus for cleaning items comprising a tank for containing a quantity of a cleaning solution, the cleaning tank having a bottom; a filter for filtering the cleaning solution; a pump for continuously recirculating cleaning solution through the tank and the filter; a sump associated with the tank and pump for continuously adding additional cleaning solution to the tank to facilitate the drawing off of light ends of greases and oils from the solution; an ultrasonic device for ultrasonically exciting cleaning solution within the tank; and a control means operable for controlling the pump in a continuous cleaning cycle wherein the cleaning solution is continuously pumped through the filter and returned to the tank.

In another preferred form, the present invention comprises a method for cleaning items, such as automobile parts, using an ultrasonic cleaning apparatus and a cleaning solution. The ultrasonic cleaning apparatus includes a tank for containing a quantity of the cleaning solution and a filter for filtering the cleaning solution. The ultrasonic cleaning apparatus further includes a pump for recirculating the cleaning solution through the tank and through the filter. An ultrasonic device is used to excite the cleaning solution within the tank. The method includes the steps of operating the apparatus in a parts cleaning cycle at times and at other times operating the apparatus in a solution cleansing cycle. In the parts cleaning cycle, the parts are placed in the tank to be cleaned, the ultrasonic device is operated, and the parts are removed from the tank. In the solution cleansing cycle, the cleaning solution is pumped through a filter and returned to the tank. In the solution cleansing cycle, at times the cleaning solution is drawn from the top of the tank for pumping through the filter and at other times the cleaning solution is drawn from the bottom of the tank for pumping through the filter. In this way, light ends of the oils and greases can be removed from the top of the cleaning solution, and heavy ends of greases and oils can be removed from the bottom of the cleaning solution.

In another aspect, the method of the present invention involves a method for cleaning items using an ultrasonic cleaning apparatus and a cleaning solution, with the ultrasonic cleaning apparatus including a tank for containing a quantity of the cleaning solution, a filter for filtering the cleaning solution, a pump for continuously recirculating the cleaning solution through the tank and the filter, a sump associated with the tank and pump for continuously adding additional cleaning solution to the tank and an ultrasonic device for ultrasonically exciting the cleaning solution within the tank, the method comprising the steps of: (i) placing parts to be cleaned into the tank; (ii) operating the ultrasonic device; (iii) continuously drawing cleaning solution from the tank to the sump for pumping through the filter; (iv) continuously pumping the cleaning solution from the sump through the filter and returning the filtered cleaning solution to the tank; and (v) removing the parts from the tank.

The apparatus according to the present invention has proven to be extremely effective in cleaning soiled parts. Also, the solution is maintained in a clear, clean condition for a relatively long time, even after repeated uses. The apparatus advantageously avoids the use of solvents, instead using a water-based cleaning solution. Moreover, the water-based (aqueous) solution is mild by comparison to known prior art aqueous solutions, which tended to be rather caustic.

Such a method and apparatus is simple, durable, and easily used. It is also environmentally friendly in that no solvents need be used or reclaimed in the use of the equipment. Moreover, the use of mild aqueous-based solution is inherently safer than the use of solvents. Also, the use of such a mild aqueous solution is less harmful to the human operators thereof, both in terms of any vapors that might be inhaled and contact with someone's skin.

Accordingly, it is a primary object of the present invention to provide a parts cleaning apparatus using an aqueous cleaning solution, which is highly effective for cleaning parts.

It is another object of the present invention to provide a parts cleaning apparatus for use with an aqueous cleaning solution, which is effective for maintaining the usefulness of the cleaning solution over many uses thereof.

It is another object of the present invention to provide a parts cleaning apparatus and method utilizing an aqueous cleaning solution, which apparatus and method is effective for efficiently separating the cleaning solution from oils and greases.

It is another object of the present invention to provide a parts cleaning apparatus and method which is simple in its construction, durable in operation and easily operated and maintained.

These and other objects, features, and advantages of the present invention will become more apparent upon reading the following specification in conjunction with the accompanying drawing figures.

DETAILED DESCRIPTION OF THE PREFERRED EMBODIMENTS

Figure 1:
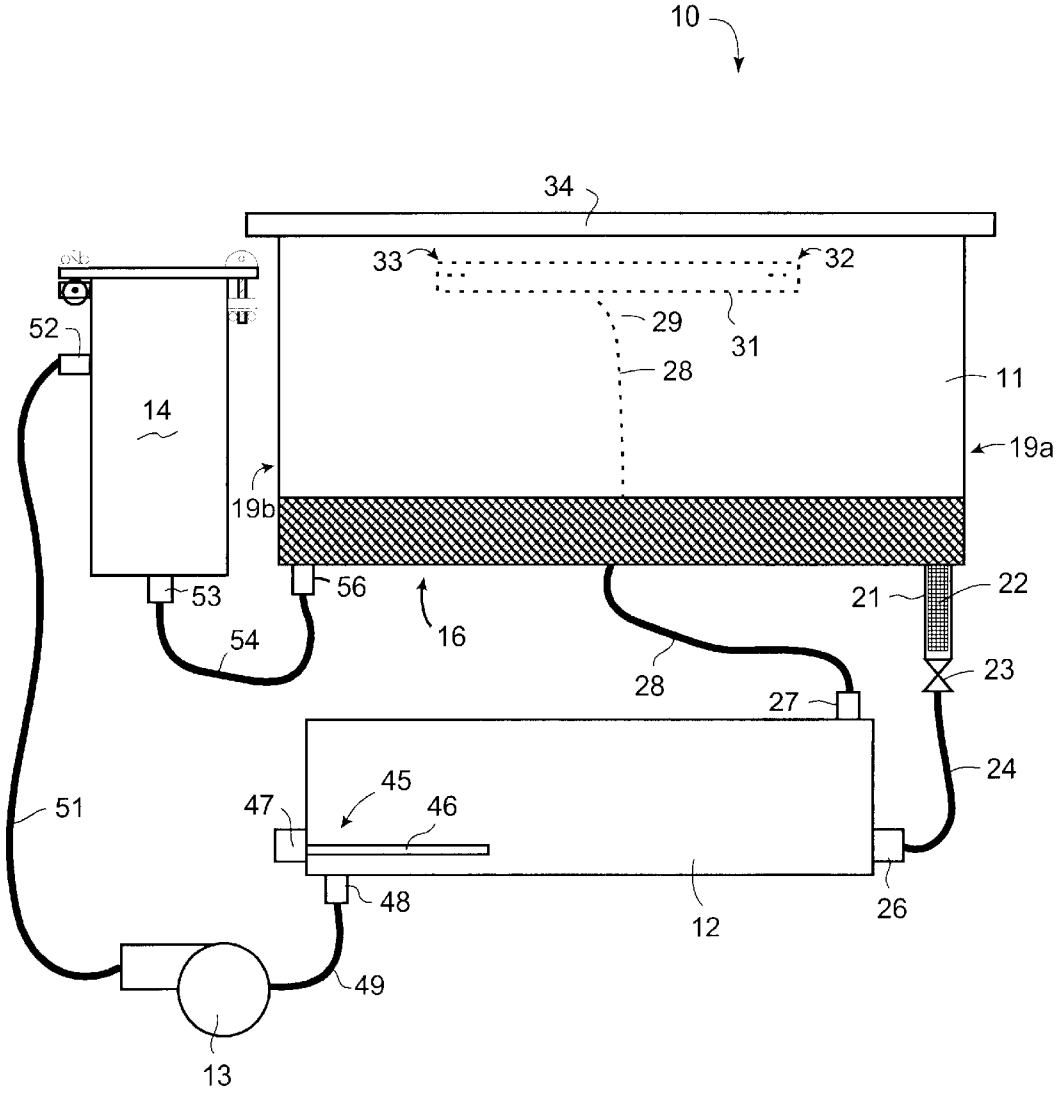
FIG. 1 is a schematic illustration of a parts washing apparatus according to a preferred form of the invention.
Figure 7:
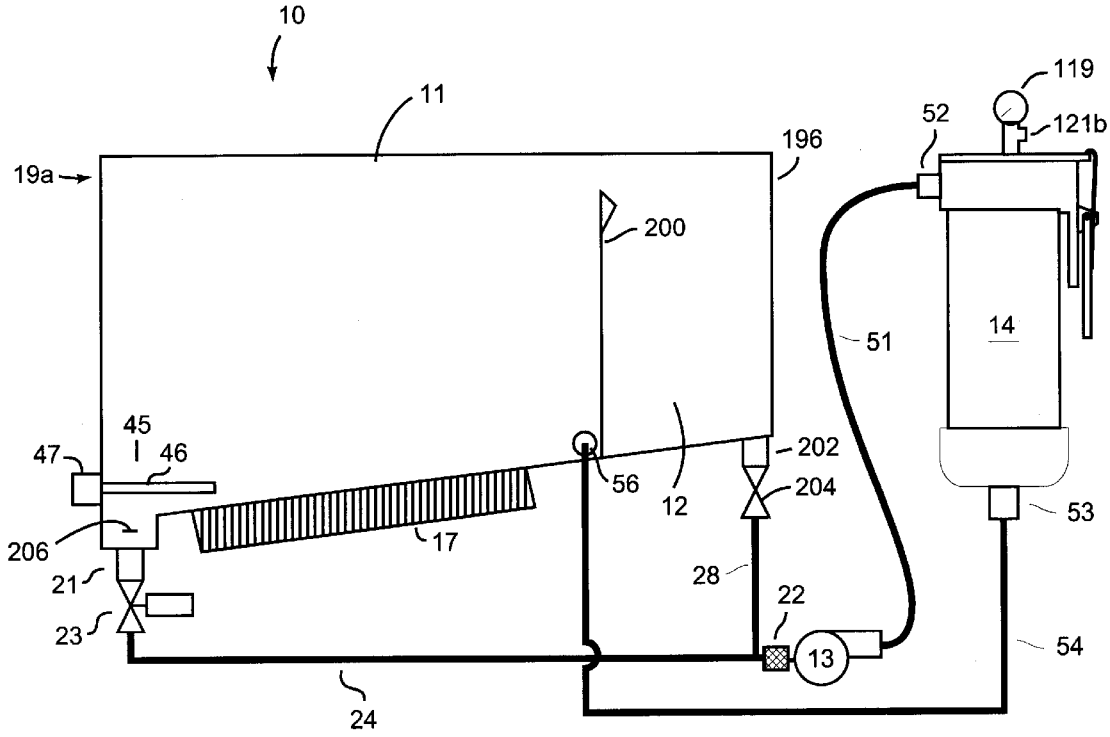
FIG. 7 is a schematic illustration of a portion of a parts washing apparatus according to another preferred form of the invention.
Figure 10:
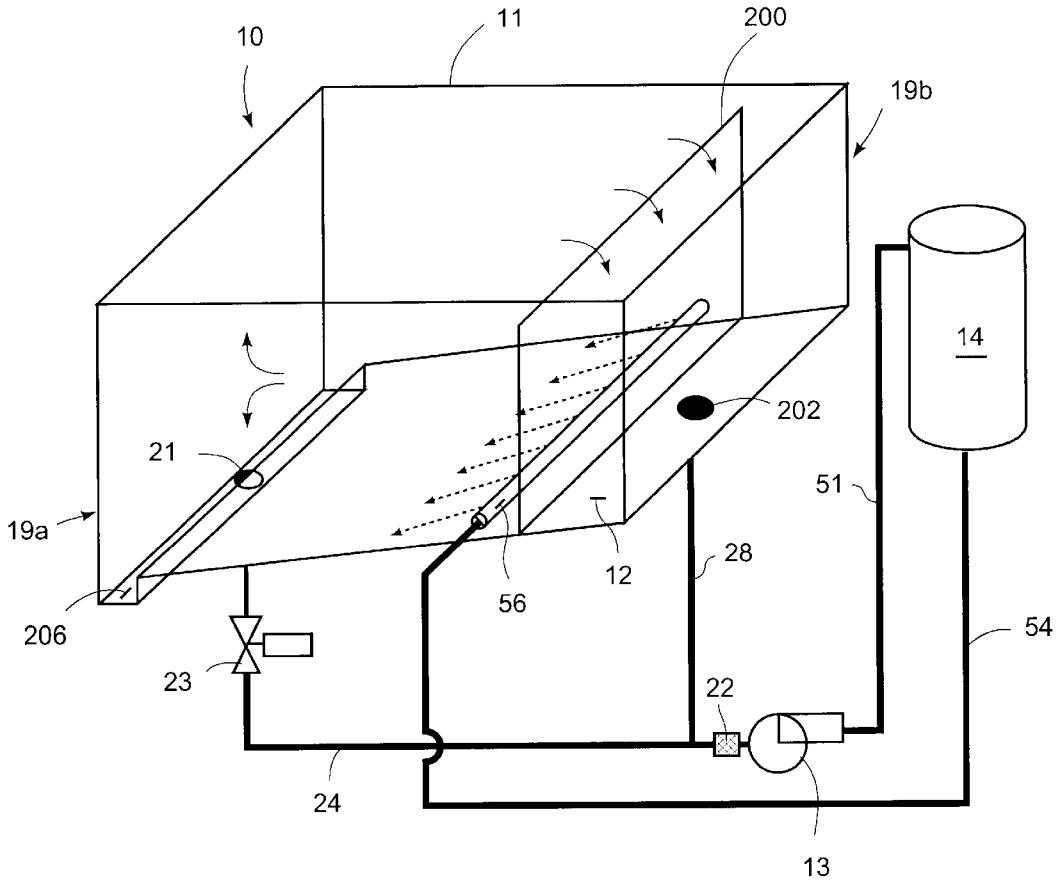
FIG. 10 is a schematic illustration of a parts washing apparatus according to another preferred form of the present invention.

Referring now in detail to the drawing figures, wherein like reference numerals represent like parts throughout the several views, FIG. 1 shows a parts cleaning apparatus 10 according to a preferred form of the invention. As depicted schematically in FIG. 1, the parts cleaning apparatus 10 includes several major components, including a cleaning tank 11, a sump tank 12, which can be a part of the main wash tank (the sump as part of the main wash tank is shown in FIGS. 7 and 10) or a separate tank (as shown in FIG. 1), a pump 13, and a filter assembly 14. The tank 11 is a stainless steel tank with a capacity of about 30 gallons of cleaning solution. The tank is generally rectangular in shape with an open top. If desired, a removable or folding cover can be provided for the tank. The tank has a generally V-shaped bottom indicated generally at 16. The V-shaped bottom helps to keep the bottom more clear of debris, thereby reducing the time needed for the liquid to reach cavitation when operating the ultrasonic apparatus, described below. The tank bottom may also be planar or flat or in a non-flat form such as conical, ribbed, corrugated, rounded, and any other appropriate geometrical shape that allows generally unrestricted flow and drainage of materials through an outlet drain. A pair of ultrasonic transducers 17 and 18 (see FIG. 2 also) extend from one end 19*a* to an opposite end 19*b* of the tank 11. The ultrasonic transducers 17 and 18 are positioned atop the bottom surface of the tank for ultrasonically exciting cleaning solution contained within the tank. A lower drain outlet 21 is positioned near the end 19*a* of the tank 11 and at the bottom thereof. The lower drain outlet 21 is positioned between the transducers 17 and 18. The lower drain outlet 21, which is in the form of a nipple or short tube, receives therein a stainless steel mesh filter or screen 22. To facilitate the easy draining of liquid and contaminates into and through the lower drain outlet 21, the tank should be leveled such that end 19*b* is slightly higher than end 19*a* so that material can flow downhill toward lower drain outlet 21.

A solenoid valve, pinch valve or butterfly valve 23 is connected to the lower drain outlet 21. The outlet from the valve 23 is directed through a flexible piping, tubing or hose 24 to an inlet 26 of the sump tank 12. The sump tank 12 also includes a second inlet 27 which in turn is coupled to another flexible hose 28. The flexible hose 28 connects to an outlet 29 of a manifold 31. The manifold 31 in turn is in fluid communication with a pair of weir holes or upper drain holes 32 and 33. Note that no valve is provided in the fluid path from the weir holes 32 and 33 to the inlet 27 of the sump tank 12. This allows bubbles which may be formed in the cleaning fluid in the sump tank 12 to rise freely and escape, thereby helping to keep the amount of air bubbles to a minimum in the cleaning solution as it is re-circulated through the system. This is beneficial when using ultrasonic generating equipment, such as contemplated here.

Alternatively, as shown in FIG. 7, although the tank should be leveled such that end 19*b* is slightly higher than end 19*a* so that material can flow downward toward lower drain outlet 21, a second drain 202 may be located at the slightly higher end 19*b*, as opposed to the tank top, for draining the cleaning solution flowing over a weir wall 200 into the sump 12. Both the sump and weir are located within the tank, the weir extending substantially, but not completely to the top of the tank 11.

The solenoid valve, pinch or butterfly valve 23 preferably should be selected to be capable of providing a completely positive closing thereof without requiring a differential pressure across the valve. Also, such a valve should be chosen to have good performance characteristics up to at least 150° Fahrenheit.

In a more preferred embodiment of this invention, valve 23 connected to drain outlet 21 is closed so that a continuous flow of cleaning solution may be maintained through the tank 11, sump tank 12, pump 13 and filter assembly 14. With "continuous" flow, the cleaning solution is constantly re-circulated and flowing through cleaning apparatus 10, including tank 11. Continuous flow may be accomplished by closing valve 23 associated with drain 21 and allowing the solution to flow through weir holes 32 and 33 to inlet 27 of sump tank 12.

As shown in FIG. 7, continuous flow of cleaning solution also may be accomplished by closing valve 23 associated with drain 21 and allowing the solution to flow over weir wall 200, into sump 12 and through a second drain 202, through mesh 22, through pump 13 and filter 14 and back into tank 11. As shown in FIG. 1, the solution flows to inlet 27 of sump 12, through pump 13 and filter assembly 14, and back to the tank 11. After completing an operation of continuous flow of cleaning solution through the tank, valve 23 is opened and any accumulated particulate and solid material is drained through outlet drain 21, through mesh 22, through pump 13 and through filter 14 putting filtered solution into tank 11.

Figure 2:
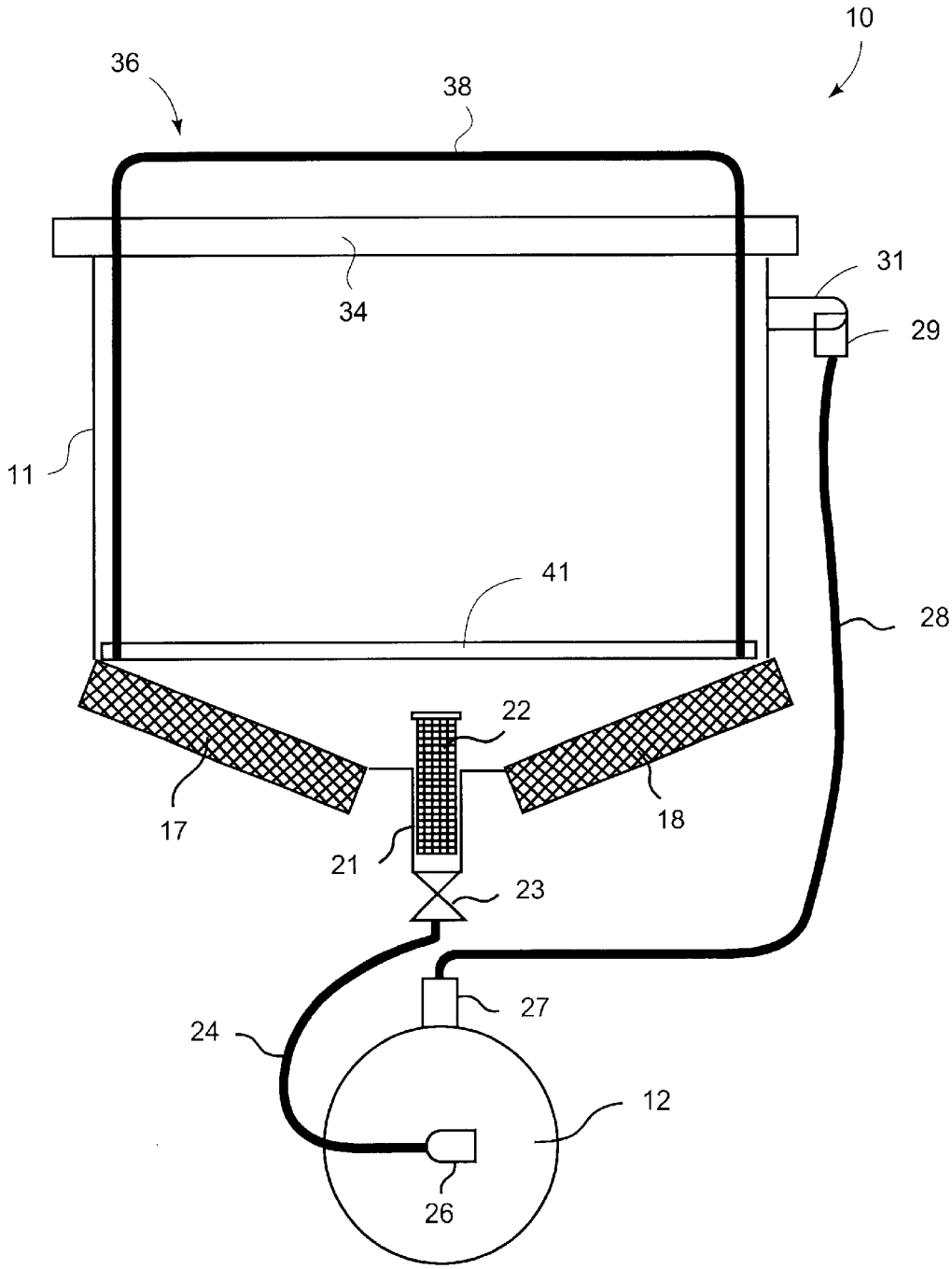
FIG. 2 is another schematic illustration of the parts washing apparatus of FIG. 1.

The large tank 11 further includes an upper peripheral flange 34 which is useful for supporting a parts basket indicated generally at 36 (see FIG. 2) in one of three different positions. While the parts basket is depicted in FIG. 2, it is omitted in FIG. 1 for simplicity. As depicted schematically in FIG. 2 and as better seen in FIG. 5, the parts basket 36 includes left and right U-shaped handles 37 and 38 and a wire mesh bottom 39 supported by a lower peripheral frame 41. Each of the U-shaped handles 37 and 38 carries six (6) L-shaped hooks, such as hooks 42 and 43 on handle 38. These hooks are arranged in pairs so that there is a lower pair, a middle pair, and an upper pair. In this way, the handles can be hooked onto the side walls of the tank 11 to secure the basket in a raised position to lift (or hold) parts out of the cleaning solution (using the lower hooks), an intermediate position partially submersing the parts to be cleaned and the basket in the cleaning solution (using the middle pair of hooks on each arm), and a fully submersed position to fully submerse parts in the cleaning solution (utilizing the upper pair of hooks on each U-shaped arm). The hooks are received in corresponding holes formed in the upper flange 34 of the tank 11. Thus, there are two holes in upper peripheral flange 34 adjacent end 19*a* and another pair of holes in the upper peripheral flange 34 adjacent end 19*b*. Instead of being received in the holes, the hooks can be slipped over the outer edges of the upper peripheral flange 34.

The sump tank 12 should be sized to contain at least about 25% as much cleaning solution as is contained within the main tank 11. Further, the sump tank 12 includes a heater, which can take any form, indicated generally at 45. The heater includes a submersible heating element 46 and external connections at 47 for connection to an appropriate electrical control system. The sump tank 12 also includes an outlet nipple 48 positioned at an opposite end of the inlet nipples 26 and 27 and positioned at the bottom of the tank. The outlet nipple 48 is coupled to a flexible hose 49 coupled to the inlet of pump 13. Preferably, an inlet filter is provided at this juncture to prevent debris from entering the pump and damaging the pump. Such a filter is not depicted in the drawing figures, but is well understood by those skilled in the art. The pump 13 preferably is a gear-type pump, centrifugal pump or diaphragm pump and preferably has a capacity of approximately one gallon per minute to about five gallons per minute (1/30 to 1/6 of the tank volume per minute) and preferably is capable of providing at least 15 psi of pressure. The outlet from the pump 13 is directed through a flexible hose 51 to an inlet 52 of the filter assembly 14.

Preferably, the filter assembly 14 houses a coalescer filter. Preferably, the filter includes a 10 micron coalescer filter element. Such coalescer filters are advantageously used in the present invention in part because such filters work better as they become coated with oil. In as much as the present invention is directed to, in part, separating the oils and the greases from the water-based cleaning solution, it is considered that such filters are ideal for this application. After the solution is filtered, it is directed through an outlet 53 and then through flexible hose 54 to an inlet 56. The inlet 56 reintroduces the filtered cleaning solution to the interior of the tank 11.

Figure 3:
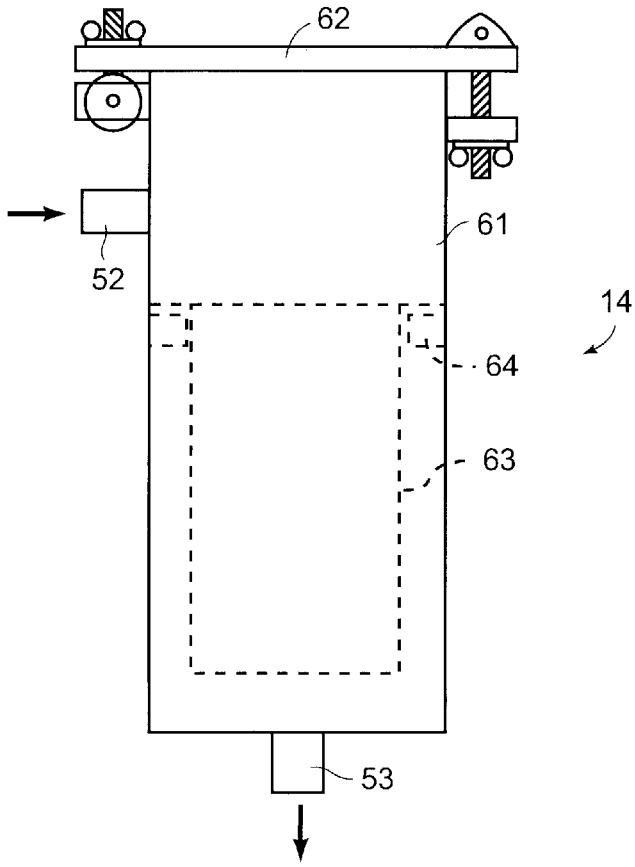
FIG. 3 is a schematic illustration of a filter assembly portion of the parts washing apparatus of FIG. 1.

Referring now to FIG. 3, the filter assembly 14 can be considered in greater detail. As shown in this figure, the filter assembly 14 includes a filter housing or filter tank 61 capped by a pivoting cover 62. Within the housing 61, a coalescer filter bag 63 is supported upon an annular filter bag support flange 64. As depicted by the flow arrows as shown in FIG. 3, the fluid flows into inlet 52 through the filter bag 63 and out through the outlet 53 for return to the tank.

Figure 4:
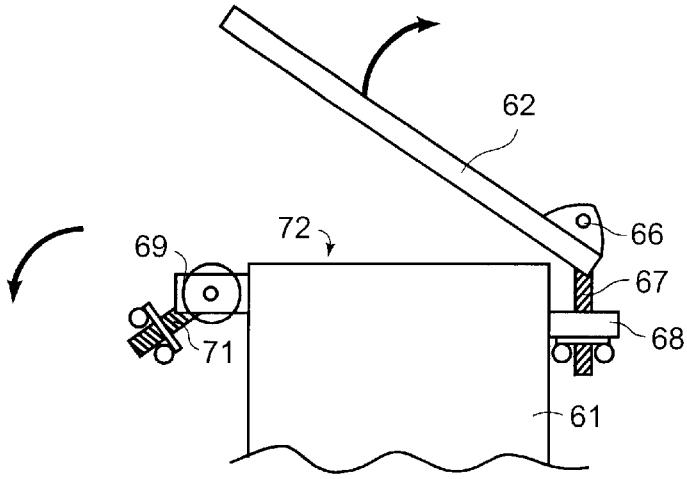
FIG. 4 is a detailed view of a portion of the filter assembly of FIG. 3.

FIG. 4 shows the pivoting nature of the pivoting cover 62 in greater detail. The pivoting cover 62 is pivoted at one end about a pivot pin 66 secured to a mounting bolt or mounting stud 67, which in turn is secured to flange or ear 68. On the opposite side of the housing 61, another flange 69 pivotally supports a clamp bolt 71 with which the pivoting cover 62 can be securely tightened against a top annular surface 72 of the housing 61. To provide a good seal at this juncture, an annular groove is formed in the annular surface of housing 61 and receives an O-ring therein.

Figure 5:
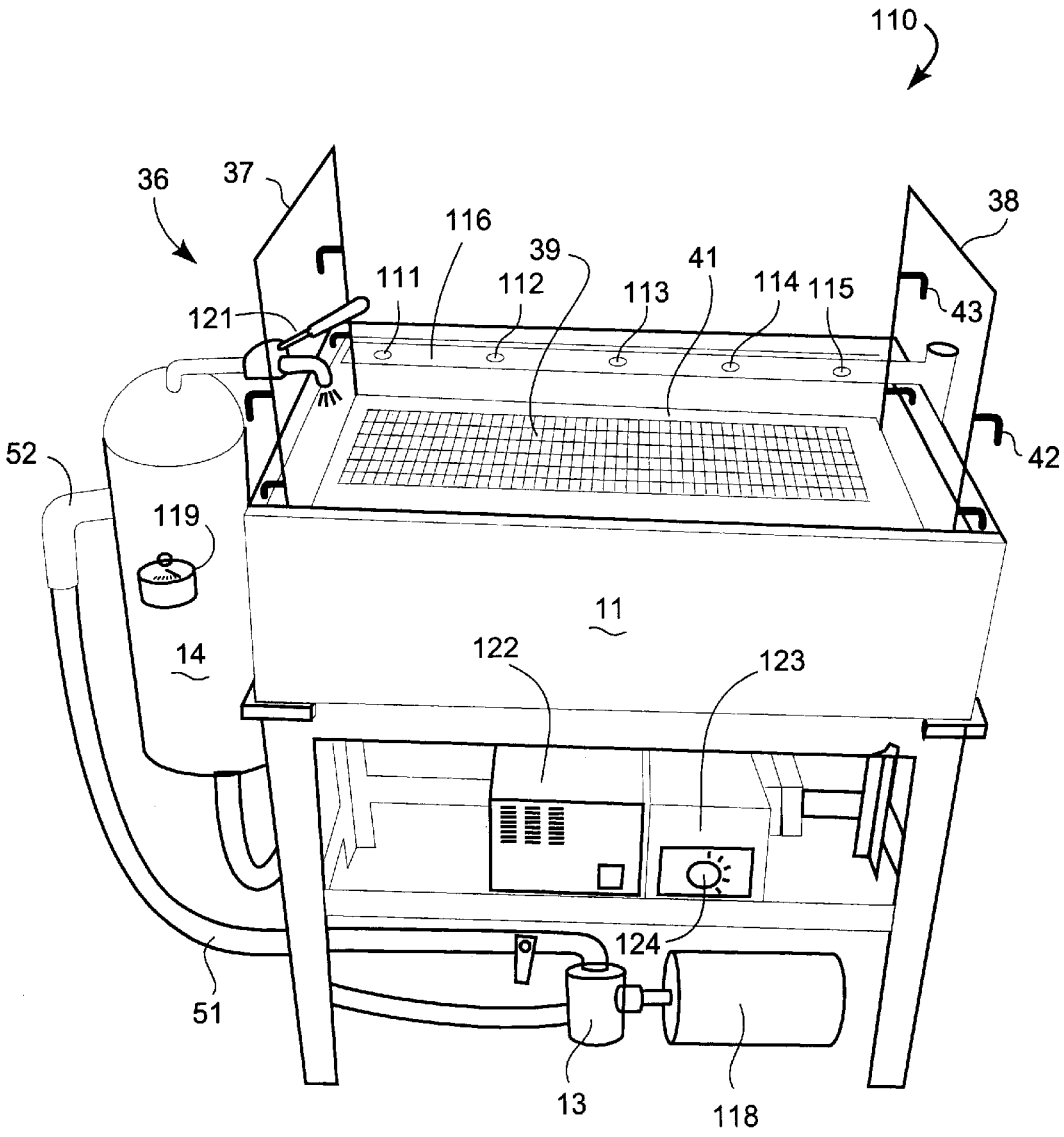
FIG. 5 is a perspective illustration of a prototype parts washing apparatus made according to the present invention.

FIG. 5 shows, in perspective, an early prototype cleaning apparatus made according to the present invention and made in accordance with the principles depicted in the proceeding figures. In this early prototype 110, the weir holes 111–115 are formed in a long pipe 116 running the length of the tank along one side thereof.

FIG. 5 also shows the prototype to include an electric motor 118 for driving the pump 13 and the output from the pump 13 goes through a flexible hose or conduit 51 to the inlet 52 of the filter assembly 14. A pressure gauge 119 is used to monitor the pressure within the filter assembly 14, and if the pressure is too great, a pressure release valve 121 can be manually operated to vent excessive pressure outwardly through a spigot positioned over the tank 11.

FIG. 5 also shows the use of an electronic ultrasonic generator controller 122 which is used to create the ultrasonic forms that drive the ultrasonic transducers positioned within the tank 11. The particular unit chosen is a Model N100-X11S01 manufactured by CAE Blackstone. Those skilled in the art will recognize that other types of ultrasonic generator devices can be employed as well. A control module 123 is provided for maintaining overall functional control of the cleaning apparatus, including the duration of operation of the ultrasonic generator, the timing and duration of the operation of the electric motor to drive the pump, the control of the valve to control the source of liquid flow to the inlet side of the pump and control of the heater. As depicted in FIG. 5, the controller 123 can include a user-setable timer dial 124 to allow a user to set how long the ultrasonic apparatus operates before the parts are ready to be removed. Alternatively, the ultrasonic generator 122 can itself contain this timer.

Figure 6:
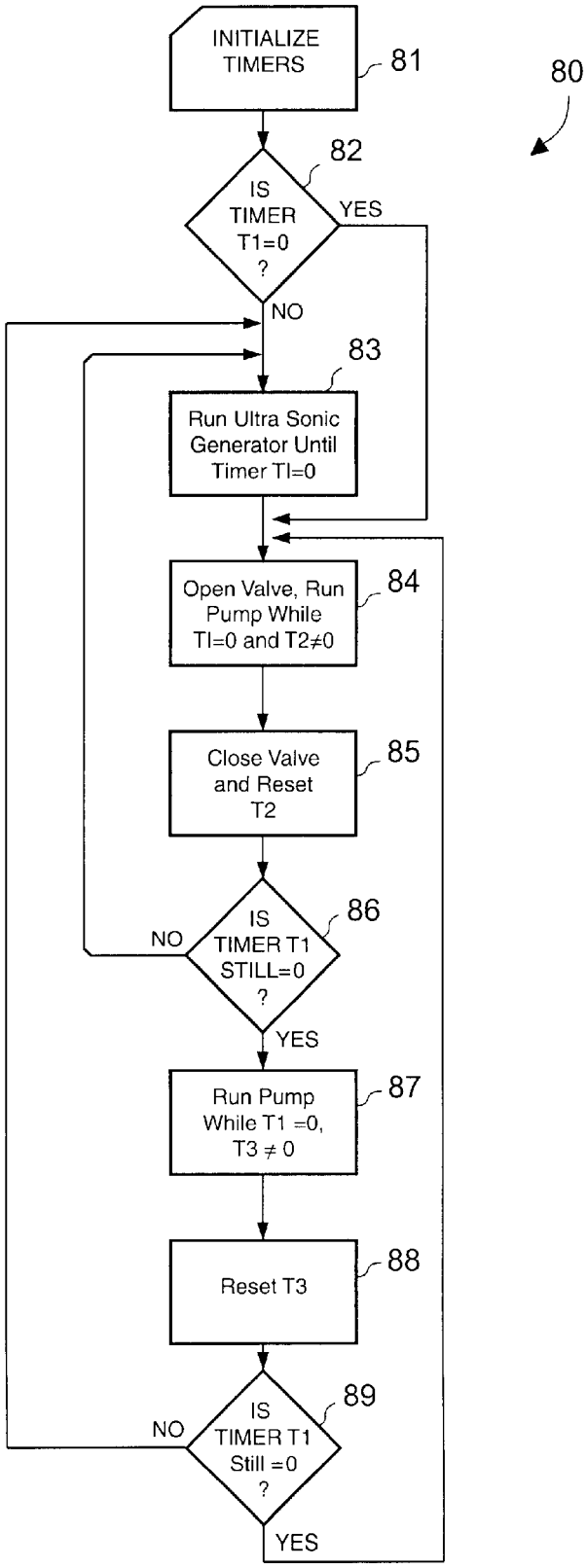
FIG. 6 is a schematic flow chart of a control scheme for operating the parts washing apparatus of FIG. 1 or FIG. 5.

Referring now to FIG. 6, the operation and control of the system is considered in greater detail. As shown in FIG. 6, the control scheme 80 includes an initial step 81 of initializing certain timer variables, namely timers T1, T2, and T3. Timer variable T1 represents for how long the ultrasonic generator should be driven. Initially, this timer variable is set to a zero value, but can be reset by a user by turning the timer dial 124. Timer variable T2 is initially set to 15 minutes (or a value that would be equivalent to 15 minutes), as is timer value T3. After initializing the timers in step 81, step 82 is a decision step in which the system is polling to see if timer variable T1 is still equal to zero. If it is, then control branches past step 83 to avoid operating the ultrasonic generator. On the other hand, if the timer variable T1 is no longer equal to zero, this is an indication that a user has reset the timer dial 124 to a non-zero value and desires to operate the cleaning apparatus. In such an event, step 83 is carried out in which the ultrasonic generator is operated until the timer winds down to have a timer variable value of T1 equals zero. Next, step 84 is carried out in which the valve is opened and then the pump is run continuously as long as timer variable T1 is equal to zero and timer variable T2 is not equal to zero (the timer has not wound down to zero). Once one of these two conditions is no longer met, step 85 is carried out in which the valve is closed again and timer variable T2 is reset to its initial value. Next, step 86 is carried out in which a decision is made to determine whether timer variable T1 is equal to zero. If it is not equal to zero, this is, as mentioned above, an indication that a user has reset the timer dial and the program branches back to step 83. If timer variable T1 is equal to zero, then step 87 is carried out in which the pump is continued to run as long as timer variable T1 is equal to zero and timer variable T3 is not equal to zero. Once one of these two conditions is no longer met, step 88 is carried out in which timer variable T3 is reset to its initial variable value. Next, step 89 is carried out in which timer variable T1 is evaluated to determine if it is still zero. If it is not still zero, the process branches back to step 83. If timer variable T1 is still equal to zero, the process branches back to step 84.

While the control scheme depicted in detail and described in detail above sounds somewhat detailed, in concept it is rather simple. Firstly, the system has two main operating modes. In one mode, parts are to be cleaned and the ultrasonic device is operated. In another mode, parts are not being cleaned, but rather, the solution itself is being cleansed. In the solution cleansing mode, the ultrasonic device is not operated, but instead the pump is run continuously and preferably the valve is cycled open and closed to allow the cleaning solution to be drawn from the bottom of the tank and then from the top, and then from the bottom again, and so on. In this way, the light ends of the oils and greases are drawn off from the top of the cleaning solution and heavy ends of the oils and greases are drawn off from the bottom of the cleaning solution. The liquid drawn off this way is pumped through the coalescing filter which removes the oils and greases from the solution and returns a clarified solution to the tank. Thus, as the parts cleaning apparatus would be used in a typical day within a facility, each time it is used to clean parts, the solution will gain a little grease and oil in the cleaning solution. Between such uses by various operators during the day, the system is self-cleansing, although it may not completely cleanse the cleaning solution between such uses. However, overnight as the system sits seemingly idle, the pump runs continuously and the valve cycles to allow the system to clarify the cleaning solution. When the shop workers return the next day, what they find is a cleaning apparatus with seemingly brand new, fresh cleaning solution.

Alternatively, as described above, the liquid can be pumped continuously into the tank from the sump to overflow the tank to achieve skimming, leaving the operator(s) to occasionally manually clean out the bottom of the tank.

In a more preferred embodiment of this invention, valve 23 connected to drain outlet 21 is closed so that a continuous flow of cleaning solution may be maintained through the tank 11, sump tank 12, pump 13 and filter assembly 14. With "continuous flow," the cleaning solution is constantly flowing and re-circulated through cleaning apparatus 10, including tank 11. Continuous flow may be accomplished by closing valve 23 associated with drain 21 and allowing the solution to flow through weir holes 32 and 33 to inlet 27 of sump tank 12 (see FIG. 1), or may be accomplished by allowing the solution to flow over weir wall 200 into sump tank 12 through hose 28 to pump 13 (see FIG. 7). Pump 13 may always be on for continuous filtering of the cleaning solution.

As shown in FIGS. 7 and 10 in particular, continuous flow also may be accomplished by closing valve 23 associated with drain 21 and allowing the solution to flow over weir wall 200, into sump tank 12 and through a second drain 202. Preferably, a solenoid valve, pinch valve or butterfly valve 204 (FIG. 7) is associated with drain 202 to control flow of the cleaning solution through drain 202 and to pump 13. The solution then flows through tube or hose 28, through mesh 22 and to pump 13 and filter assembly 14, and back to the tank 11. After completing an operation of continuous flow of cleaning solution through the tank, valve 23 is opened and any accumulated particulate and solid material is drained through outlet drain 21, valve 23 and hose 24 to mesh screen 22, and through pump 13 and filter 14 and back into tank 11.

Further, in the embodiment of FIGS. 7 and 10, the bottom of tank 11 is flat or planar rather then V-shaped, and is sloped downward toward trough 206 having outlet drain 21. The cleaning solution and debris flows toward drain 21 and therethrough for filtration. After the solution is filtered, it is directed through an outlet 53 and then through flexible hose 54 to an inlet header 56. The inlet 56 reintroduces the filtered cleaning solution to the interior of tank 11 along and across the bottom of the tank to create a circulated flow of cleaning solution and move debris down to trough 206.

Preferably, the apparatus and method according to the present invention takes advantage of a non-emulsifying aqueous-based cleaning solution. By utilizing a non-emulsifying solution, the oils and greases are easily separated from the cleaning solution by the coalescing filter. This has the effect of reducing waste from the ultrasonic cleaning process (by concentrating the soils and debris in the coalescing filter) and extending the life of the solution. Conventional emulsifying cleaning solutions cannot be easily (if at all) cleaned utilizing conventional filtration techniques. The present invention utilizes a solution that provides an effective cleaning agent in an ultrasonic cleaning process, yet can be cleaned using conventional inexpensive coalescing filtering technology.

When the apparatus according to the present invention is actively cleaning parts, the solution may appear at that moment somewhat dirty, but over time after the ultrasonic generator is turned off and the solution cleansing cycle operates to clarify the solution, the solution will return to a rather clear (non-turbid) state.

As mentioned above, preferably the cleaning solution is a water-based solution and is a non-emulsifying solution. That is to say that any tendency of the solution to emulsify the oils and greases is minimized. In this way, the oils and greases are easily and effectively separated from the water-based cleaning solution and a clarified cleaning solution can be returned to the tank for continued use.

The utilization of continuous flow through the ultrasonic cleaning apparatus keeps the apparatus functioning efficiently when the non-emulsifying solution is used with the apparatus. The non-emulsifying cleansing solution has a tendency to separate out the soils at both the top and bottom of the solution. The soils (debris, grease and oils) that settle out on the bottom of the tank dampen the ultrasonic energy that is transmitted into the solution. This creates a condition that requires a significantly longer time to clean the parts in the apparatus.

Utilizing an inlet header 56 at the bottom of the tank helps eliminate this condition, although this configuration is not required for cleaning. The inlet header sprays or moves the soils and debris down the sloped bottom of tank 11 into trough 206. Trough 206 preferably has an actuated valve 23 that intermittently opens enabling the soils and debris accumulated at the bottom of the tank to be filtered from the solution. Operational experience has shown that the alternating cycle, inlet header and sloped bottom in a improves debris movement the cleaning solution continuously flows.

Preferably, the apparatus and method according to the present invention takes advantage of a non-emulsifying aqueous-based cleaning solution. By utilizing a non-emulsifying solution, the oils and greases are easily separated from the cleaning solution by the coalescing filter. Moreover, they are more easily separated using the upper and lower drains. When the apparatus according to the present invention is actively cleaning parts, the solution may appear at that moment somewhat dirty, but over time after the ultrasonic generator is turned off and the solution cleansing cycle operates to clarify the solution, the solution will return to a rather clear (non-turbid) state.

Preferably, the apparatus and method according to the present invention takes advantage of a non-emulsifying aqueous-based cleaning solution. By utilizing a non-emulsifying solution, the oils and greases are easily separated from the cleaning solution by the coalescing filter. Moreover, they are more easily separated using the upper and lower drains. When the apparatus according to the present invention is actively cleaning parts, the solution may appear at that moment somewhat dirty, but over time after the ultrasonic generator is turned off and the solution cleansing cycle operates to clarify the solution, the solution will return to a rather clear (non-turbid) state.

As mentioned above, preferably the cleaning solution is a water-based solution and is a non-emulsifying solution. That is to say that any tendency of the solution to emulsify the oils and greases is minimized. In this way, the oils and greases are easily and effectively separated from the water-based cleaning solution and a clarified cleaning solution can be returned to the tank for continued use.

Preferably, the heater 45 is operated in a manner to heat the cleaning solution to a working temperature of between about 100° F. and 160° F. Most preferably, the heater is operated to maintain the cleaning solution at a temperature near 125° F. Heating the cleaning solution improves the ultrasonic cleaning action. Moreover, the heated cleaning solution in turn heats the items to be cleaned, softening and loosening oils and greases thereon.

Figure 8:
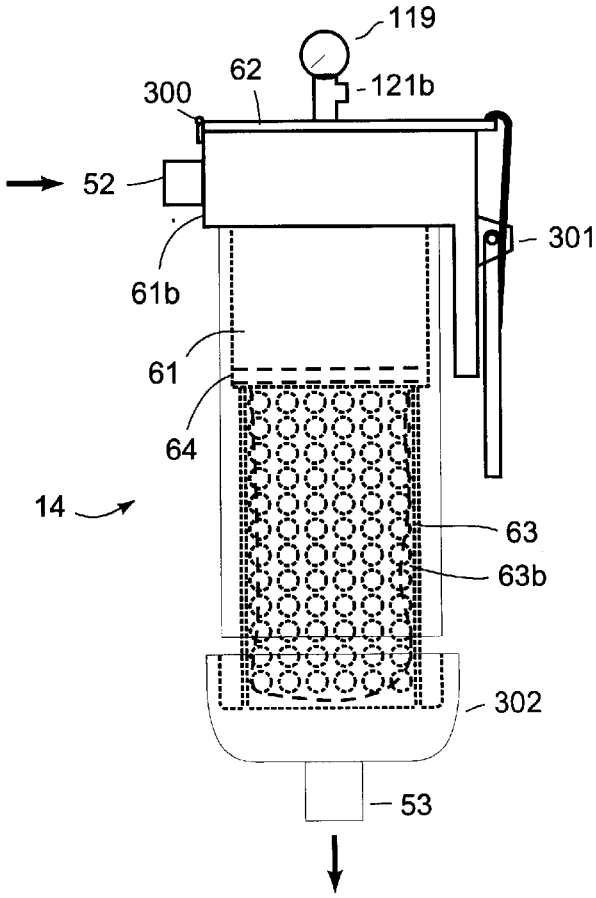
FIG. 8 is a schematic illustration of a filter assembly portion of the parts washing apparatus of FIG. 7.

Referring now to FIG. 8, another more preferred embodiment of the filter assembly 14 is shown. In this figure, the filter assembly 14 includes a filter housing 61 capped by a pivoting cover 62 having a hinge 300 and a hook-style pull action toggle clamp 301. Cover 62, hinge 300 and hook-style pull action toggle clamp 301 are part of a metal cap or head 61*b* that screws onto housing 61. Cover 62 also includes a pressure gauge 119 and relief valve 121*b*. Within the housing 61, a coalescer filter bag 63 is supported upon an annular filter bag support flange 64 and sits in metal sleeve 63*b*. As depicted by the flow arrows as shown in FIG. 10, the fluid flows into inlet 52 through the filter bag 63 and out through the outlet 53 for return to the tank.

Figure 9:
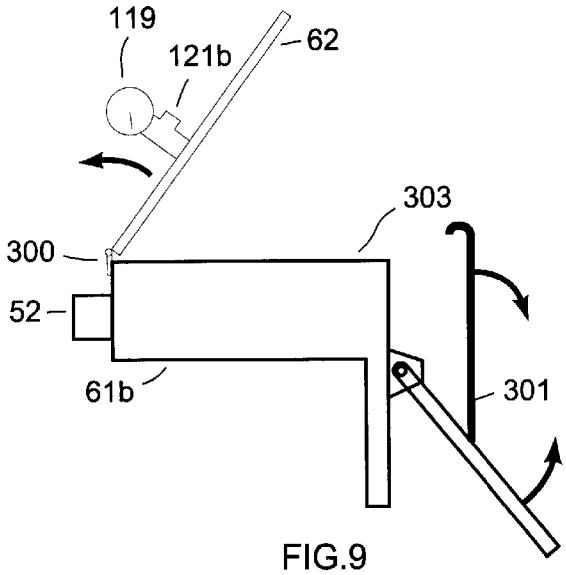
FIG. 9 is a detailed view of a portion of the filter assembly of FIG. 8.

FIG. 9 shows the pivoting nature of the pivoting cover 62 of FIG. 8 in greater detail. The pivoting cover 62 is pivoted at one end about a hinge 300 secured to metal cap or head 61*b*, which in turn is secured to housing 61. On the opposite side of the metal head 61*b*, a hook-style pull action toggle clamp 301 is located with which the pivoting cover 62 can be securely tightened against a top annular surface of the metal cap or head 61*b*. To provide a good seal at this juncture, an annular groove is formed in the annular surface of metal head 61*b* and receives an O-ring 303 therein.

While the invention has been disclosed in preferred forms, those skilled in the art will recognize that many modifications, additions, and deletions can be made therein without departing from the spirit and scope of the invention as set forth in the following claims.

What is claimed is:

1. An ultrasonic parts cleaning apparatus for cleaning items, said apparatus for use with a cleaning solution, said apparatus comprising:

a tank for containing a quantity of the cleaning solution;

a filter for filtering the cleaning solution;

a pump for recirculating cleaning solution through the tank and the filter;

an ultrasonic device for ultrasonically exciting cleaning solution within said tank; and a control means operable for controlling said pump and said ultrasonic device in a parts cleaning cycle and in a solution cleansing cycle, and wherein in said parts cleaning cycle said control means is operable for operating said ultrasonic device, wherein said control means is operable in said solution cleansing cycle for pumping cleaning solution through the filter and returning the filtered cleaning solution to said tank, and wherein said control means is further operable for alternately drawing liquid from a top and a bottom of said tank in an alternating cycle.

2. An ultrasonic parts cleaning apparatus as claimed in claim 1 further comprising a lower drain for drawing the cleaning solution from the bottom of the tank.

3. A parts cleaning apparatus as claimed in claim 2 further comprising a valve associated with said lower drain and said control means.

4. A parts cleaning apparatus as claimed in claim 1 further comprising a sump associated with said pump for adding additional cleaning solution to said tank to facilitate the drawing off of debris therefrom.

5. A parts cleaning apparatus as claimed in claim 1 wherein said filter comprises a coalescing filter.

6. A parts cleaning apparatus as claimed in claim 1 further comprising upper drains, a lower drain, a valve associated with said lower drain, and a large capacity sump positioned in-line between said pump and said valve.

7. An ultrasonic cleaning apparatus, for use with a cleaning solution for cleaning items, said cleaning apparatus comprising:

a cleaning tank for containing a quantity of the cleaning solution therein and in which the items to be cleaned can be placed therein, said cleaning tank having at least one upper drain and at least one lower drain;

at least one ultrasonic device for ultrasonically exciting the cleaning solution contained within said cleaning tank;

control means operable for drawing said cleaning solution from at least one filter for filtering said cleaning solution and said cleaning tank through said at least one upper drain and through said at least one lower drain; directing said cleaning solution through said at least one filter, and returning filtered cleaning solution to said cleaning tank.

8. A cleaning apparatus as claimed in claim 7 wherein said control means is operable for alternately drawing said cleaning solution from said lower drain and from said upper drain in an alternating cycle.

9. A cleaning apparatus as claimed in claim 8 wherein said control means is operable for alternately drawing said cleaning solution from said lower drain and from said upper drain in an alternating cycle when said ultrasonic device is not operating.

10. A cleaning apparatus as claimed in claim 7 further comprising a pump for recirculating said cleaning solution through said filter and said tank.

11. A cleaning apparatus as claimed in claim 7 further comprising a sump for housing an additional quantity of said cleaning solution which can be pumped into said tank to facilitate the removal of debris from said tank.

12. A cleaning apparatus as claimed in claim 7 wherein said filter comprises a coalescing filter.

13. A cleaning apparatus as claimed in claim 7 wherein the bottom of the tank is sloped and the ultrasonic device is disposed adjacent the sloped tank bottom so that debris cleaned from the items in the tank is encouraged to fall down the sloped tank bottom instead of building up over the ultrasonic device.

14. A cleaning apparatus as claimed in claim 7 further comprising a trough located at the bottom of the tank to accumulate soils and debris.

15. A cleaning apparatus as claimed in claim 14 further comprising an inlet located at the bottom of the tank for spraying filtered cleaning solution along the bottom of the tank toward the trough.

16. A parts cleaning apparatus as claimed in claim 7 wherein the cleaning tank has an inlet for returning the filtered liquid to the tank, and the inlet is separate from the lower drain and the upper drain.

17. A parts cleaning apparatus as claimed in claim 7 wherein the at least one upper drain is positioned for drawing liquid from adjacent an upper surface of the cleaning solution contained within the tank and the at least one lower drain is positioned for drawing liquid from adjacent a bottom of said cleaning tank.

18. An ultrasonic parts cleaning apparatus comprising:

a tank for containing a quantity of a cleaning solution, the cleaning tank having a sloped bottom with a lower end, a first drain for drawing the solution and heavier debris from adjacent the lower end of the sloped bottom, and a second drain for drawing lighter debris from the tank after it has been skimmed from the solution;

a filter for filtering the cleaning solution;

a pump for recirculating the cleaning solution through the tank and the filter;

an ultrasonic device for ultrasonically exciting the cleaning solution within the tank; and a control means operable for controlling the pump in a cleaning cycle wherein the cleaning solution is pumped through the filter and returned to the tank.

19. The cleaning apparatus of claim 18 wherein the ultrasonic device is positioned adjacent the sloped bottom of the tank.

20. The cleaning apparatus of claim 18 further comprising a sump for receiving the lighter debris skimmed from the solution, wherein the second drain is disposed in the sump.

21. The cleaning apparatus of claim 20 further comprising a weir adapted for skimming the lighter debris from the solution and into the sump, wherein the weir is positioned between the first drain and the second drain.

22. The cleaning apparatus of claim 21 wherein the sump is disposed within the tank and the weir at least partially defines the sump.

23. The cleaning apparatus of claim 18 further comprising a trough located at the lower end of the sloped bottom of the tank to accumulate soils and debris.

24. The cleaning apparatus of claim 23 further comprising an inlet located at the bottom of the tank for spraying filtered cleaning solution along the bottom of the tank toward the trough.

25. The cleaning apparatus of claim 18, wherein the filter comprises a coalescing filter.

26. An ultrasonic parts cleaning apparatus comprising:

a tank for containing a quantity of a cleaning solution, the tank having a sloped bottom and a trough located at the bottom of the tank to accumulate soils and debris;

a filter for filtering the cleaning solution;

a pump for continuously recirculating cleaning solution through the tank and the filter;

a sump associated with the tank and pump for continuously adding additional cleaning solution to the tank to facilitate the drawing off of light greases and oils from the solution;

a weir located within the tank, at least partially defining the sump, and adapted for skimming lighter debris from the solution in the cleaning tank;

a first lower drain, a second lower drain with the weir disposed between the first drain and the second drain;

an inlet located at the bottom of the tank for spraying filtered cleaning solution along the bottom of the tank toward the trough;

an ultrasonic device for ultrasonically exciting the cleaning solution within the tank, wherein the ultrasonic device is positioned adjacent the sloped bottom of the tank; and a control means operable for controlling the pump in a continuous cleaning cycle wherein the cleaning solution is continuously pumped through the filter and returned to the tank.

27. An ultrasonic parts cleaning apparatus for use with a cleaning solution for cleaning items, the cleaning apparatus comprising:

a cleaning tank for holding the cleaning solution and the items to be cleaned, the cleaning tank having a sloped interior surface;

at least one ultrasonic device for ultrasonically exciting the cleaning solution held in the cleaning tank, the ultrasonic device disposed on the sloped interior surface of the tank so that debris cleaned from the items in the tank is encouraged to fall down the sloped interior surface instead of building up over the ultrasonic device;

a filter for filtering the cleaning solution; and control means operable for drawing the cleaning solution from the tank, passing the cleaning solution through the filter, and returning the filtered cleaning solution to the tank.

28. The ultrasonic cleaning apparatus of claim 27, wherein the sloped interior surface has at least one lower end, and further comprising at least one trough adjacent the lower end to accumulate soils and debris.

29. The ultrasonic cleaning apparatus of claim 28, further comprising at least one lower drain in the trough.

30. The ultrasonic cleaning apparatus of claim 29, further comprising at least one inlet adjacent the ultrasonic device.

31. The ultrasonic cleaning apparatus of claim 27, wherein the sloped interior surface is generally V-shaped or planar.

32. The ultrasonic cleaning apparatus of claim 27, wherein the control means is operable for continuously recirculating the cleaning solution through the tank and the filter.

33. The ultrasonic cleaning apparatus of claim 27, wherein the cleaning tank has at least one upper drain and at least one lower drain, and the control means is operable for drawing liquid from the at least one upper drain or from the at least one lower drain.

34. The ultrasonic cleaning apparatus of claim 33, wherein the control means is operable for alternately drawing liquid from the lower drain and from the upper drain in an alternating cycle.

35. The ultrasonic cleaning apparatus of claim 27, wherein the interior surface is defined by a bottom of the tank.

* * * * *